United States Patent [19]

Cotter

[11] 4,001,995

[45] Jan. 11, 1977

[54] METAL ROOFING/SIDING SYSTEM

[75] Inventor: Donald Cotter, Pacifica, Calif.

[73] Assignee: Field Form, Inc., Pacifica, Calif.

[22] Filed: Sept. 8, 1975

[21] Appl. No.: 611,298

[52] U.S. Cl. ..... 52/460; 52/469; 52/584

[51] Int. Cl.[2] ..... E04C 1/34

[58] Field of Search ..... 52/460, 461, 463, 584, 52/470, 537, 469, 222

[56] References Cited

UNITED STATES PATENTS

| | | | |
|---|---|---|---|
| 2,907,287 | 10/1959 | Trostle | 52/461 X |
| 3,002,591 | 10/1961 | Hess | 52/584 X |
| 3,063,201 | 11/1962 | Rylander | 52/470 X |
| 3,139,961 | 7/1964 | Ferrell | 52/463 |
| 3,213,583 | 10/1965 | Winski | 52/469 X |
| 3,603,056 | 9/1971 | Roth et al. | 52/460 |

*Primary Examiner*—Price C. Faw, Jr.
*Assistant Examiner*—Carl D. Friedman
*Attorney, Agent, or Firm*—Townsend and Townsend

[57] ABSTRACT

A roofing and siding system is disclosed. The system includes a plurality of elongate, generally planar sheets each having upwardly projecting flanges disposed along the lateral edges of the sheet. The flanges each have an outwardly directed C-shaped cross section. The sheets are placed side-by-side so that the lateral edges thereof are juxtaposed to corresponding lateral edges of adjacent sheets to provide a surface comprising the exposed surface of a building. Clips are provided for attaching the planar sheets to the building. A plurality of elongate battens are provided which are constructed of resilient material. Each batten has a generally rectangular cross section including two longer, substantially parallel sides and two relatively shorter sides. One of the shorter sides of each batten is slit so that the batten can be snapped over adjacent flanges on juxtaposed lateral edges of two of the planar sheets to provide weatherproofing at the edges.

9 Claims, 7 Drawing Figures

METAL ROOFING/SIDING SYSTEM

BACKGROUND OF THE INVENTION

The present invention provides a roofing and siding system employing a plurality of planar sheets which are clipped to a building and interconnected by battens to form the exposed surface of a building.

A wide variety of systems are known in which the roofing or siding of a building is constructed by joining together a plurality of elongate planar sheets. For example, such systems are shown in the patent to Huntington, U.S. Pat. No. 2,855,871; the patent to Mackey, U.S. Pat. No. 3,335,537; and the patent to Gyekis, U.S. Pat. No. 3,376,680. These systems generally utilize a plurality of elongate planar sheets which are placed side-by-side to form the exposed surface of a building. Battens are snapped over adjacent edges of the respective sheets to provide a weatherproof covering. Such systems have become quite popular but certain problems have arisen in the use of such systems. It has been found with known devices of this type that rain water tends to seep upwardly along the inside surfaces of the battens. The adjacent edges of the sheets do not actually contact one another under the battens so that the water is allowed to pass between the sheets and the weatherproofing provided is not as effective as desired. In addition, difficulties are encountered when attempts are made to place the sheets around adjacent non-coplanar surfaces, such as at the peak of a roof. Battens found in the prior art cannot negotiate such corners, leaving a break or seam at which the weatherproofing may fail. Also, the sheets are attached to the building using elongate, continuous fasteners. When the system is exposed to the sun, differential expansion can occur and the sheets may buckle.

SUMMARY OF THE INVENTION

The present invention provides an improved roofing and siding system. The system includes a plurality of elongate, generally planar sheets each having upwardly projecting flanges disposed along the lateral edges of the sheet. The flanges each have an outwardly directed C-shaped cross section. The sheets are placed side-by-side so that the lateral edges thereof are juxtaposed to corresponding lateral edges of adjacent sheets to provide a surface comprising the exposed surface of a building. Clips are provided for attaching the planar sheets to the building. A plurality of elongate battens are provided which are constructed of resilient material. Each batten has a generally rectangular cross section including two longer, substantially parallel sides and two relatively shorter sides. One of the shorter sides of each batten is slit so that the batten can be snapped over adjacent flanges on juxtaposed lateral edges of two of the planar sheets to provide weatherproofing at the edges.

With the system of the present invention, the longer sides of each batten are substantially parallel. As a result, these longer sides can be cut so that the battens can be folded with the longer sides partially overlapping. This construction provides a continuous weatherproofing at the junction of non-coplanar sheets. No seam or break exists between battens at the junction of non-coplanar sheets so that the weatherproofing of the system at such points is not degraded.

In addition, in the preferred embodiment of the present invention, the upper portion of each C-shaped flange extends outwardly more than the lower portion thereof. As a result, when the sheets are placed side-by-side, the upper portions of adjacent C-shaped flanges on juxtaposed edges of adjacent sheets are compressed together to provide further weatherproofing. In addition, the upper portions of the flanges can be caulked. As a result, any water which seeps up along the inside surfaces of the battens cannot pass between adjacent planar sheets, and an efficient and effective weatherproofing system is provided.

Another feature of the preferred embodiment of the present invention is that a plurality of discrete clips are used to attach the planar sheets to the building. The sheets can slide relative to their clips to allow for expansion of the sheets when exposed to the sun. As a result, buckling of the sheets due to differential expansion of the sheets and the attachment means is avoided.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
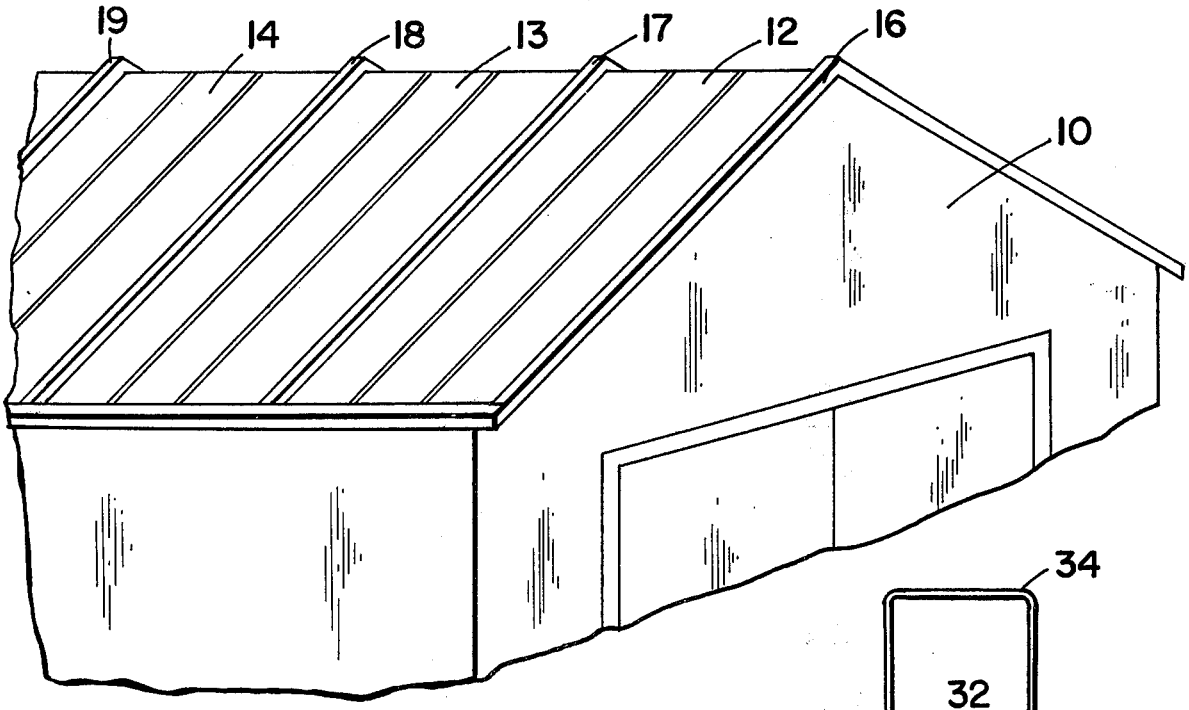
FIG. 1 is a perspective view of a building employing the roofing and siding system of the present invention.

The use of the system of the present invention to cover the roof of a building 10 is illustrated by way of reference to FIG. 1. It is to be understood that this system can also be used as siding, or as both roofing and siding. The system includes a plurality of generally planar sheets of material 12–14 arranged in a side-by-side configuration. Planar sheets 12–14 can be constructed of aluminum, sheet steel or other desired materials. The junctions between adjacent planar sheets 12–14 are covered by a plurality of battens 16–19. As described in more detail hereinbelow, the combination of planar sheets 12–14 and battens 16–19 provide a weatherproof roof or siding for the building.

Figure 2:
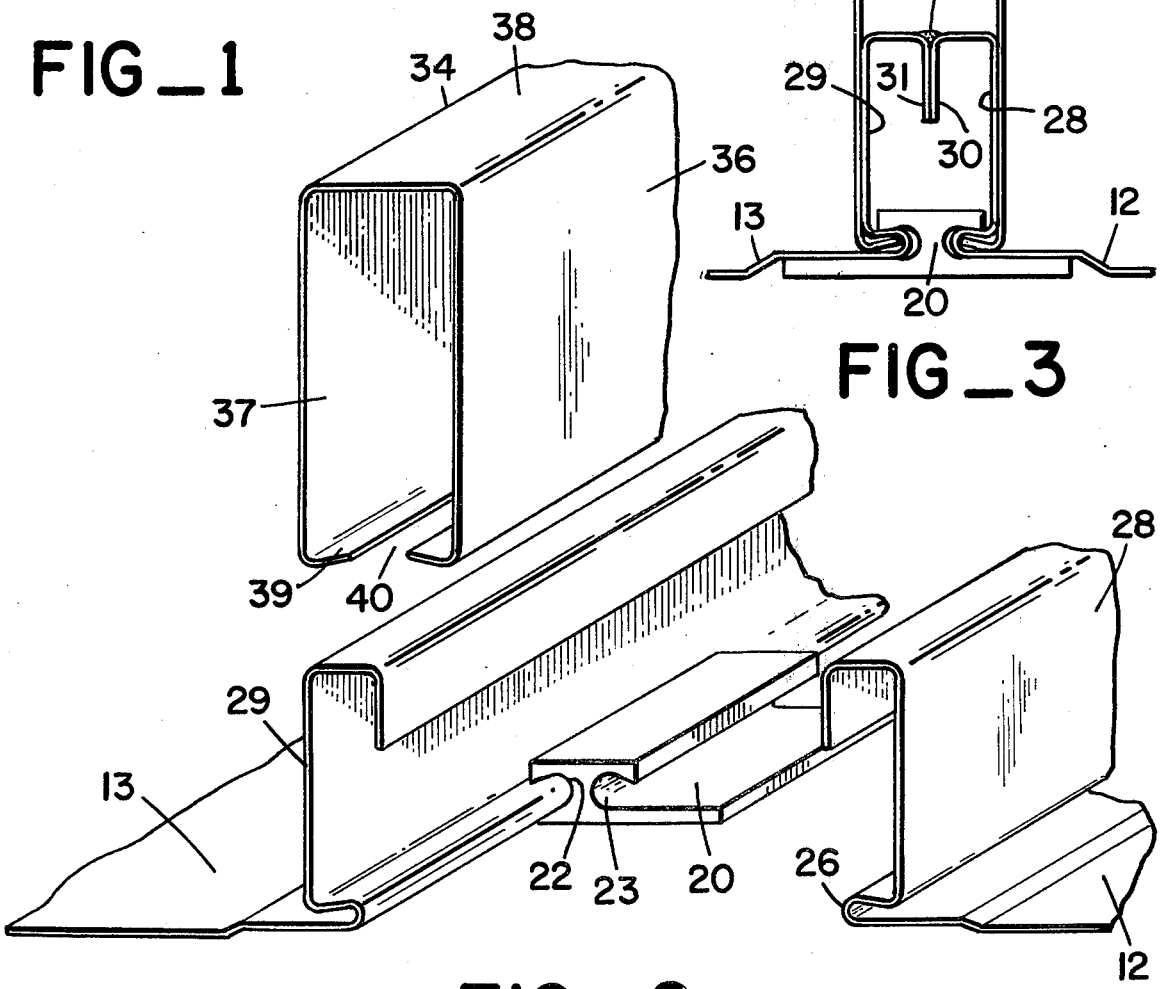
FIG. 2 is an exploded fragmentary view illustrating the installation of the roofing and siding system of the present invention.

The manner in which adjacent planar sheets such as 12, 13 are joined together at their adjacent lateral edges is illustrated by way of reference to FIG. 2. Initially, planar sheet 13 is installed and positioned on the building. Thereafter, a plurality of discrete clips 20 are installed along the exposed lateral edge of sheet 13. Each clip 20 has an oppositely disposed pair of recesses 22, 23, one of which is adapted to engage the edge of planar sheet 13. A plurality of such clips 20 are fixed to the building along the exposed lateral edge of planar sheet 13 so that the planar sheet is firmly attached to the building. Planar sheet 13 can slide relative to clips 20 to allow for heat expansion of the sheet.

After installation of clips 20, planar sheet 12 is installed by engaging the lateral edge 26 thereof with recesses 23 in the clips. In this manner, lateral edge 26 of planar sheet 12 is firmly fixed to the building. The process can be repeated to attach a plurality of such planar sheets in sequence to cover the exposed surface of a building.

Figure 3:
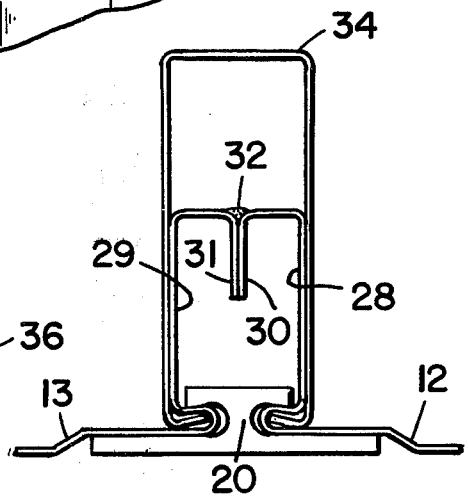
FIG. 3 is an end elevation view of the junction between adjacent planar sheets using the system of the present invention.

As is apparent from viewing FIGS. 2 and 3 in combination, the lateral edges of each planar sheet 12, 13 are provided with upwardly directed flanges 28, 29. Each flange 28, 29 has a generally C-shaped cross section. The upper edge of each C-shaped flange 28, 29 extends outwardly more than the lower portion thereof so that when sheets 12 and 13 are installed as illustrated in FIG. 3, the upper portions 30, 31 of the respective flanges are compressed together to provide a waterproofed connection. In addition, caulking 32 may be applied to the junction between upper portions 30, 31 of flanges 28, 29 to further provide a weatherproof seal between the flanges.

After installation of planar sheets 12, 13, a batten 34 is slipped over flanges 28, 29. Batten 34 includes two generally parallel longer sides 36, 37 and two shorter sides 38, 39. Short side 39 is slit at 40 so that the batten can be slipped over flanges 28, 29 as illustrated in FIG. 3.

The use of battens placed over flanges at the edges of adjacent planar sheets is known in the prior art. However, it has been found that water can seep upwardly along the inside surfaces of the battens by capillary action. Accordingly, with the system of the present invention, the upper portions 30, 31 of flanges 28, 29 are compressed together so that this water cannot seep between the planar sheets. In addition, caulking 32 is provided for further weatherproofing. In this manner, seepage of water through the roofing and sliding between adjacent planar sheets is substantially prevented.

An additional feature of the present invention not found in the prior art is that the longer sides of the battens are generally parallel. As a result, the battens can be used to span intersections between non-coplanar planar sheets, as illustrated in FIGS. 4 and 5.

Figure 4A:
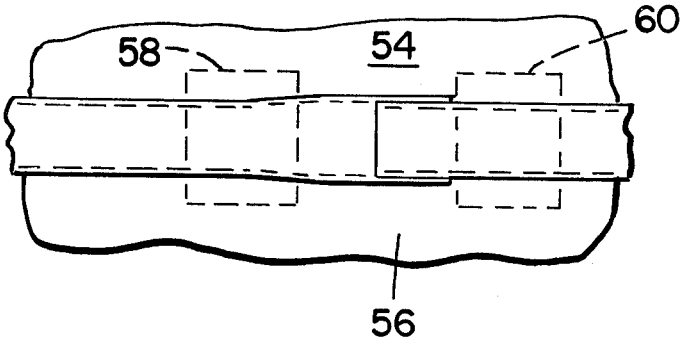
FIGS. 4A and B are plan and elevation views respectively of the use of the system of the present invention at the peak of a roof.
Figure 4B:
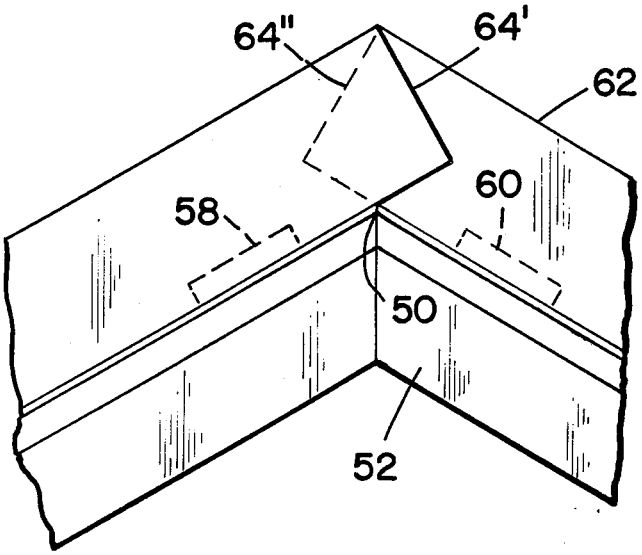

In FIGS. 4A and B, the use of the system of the present invention in spanning the peak 50 of roof 52 is illustrated. Planar sheets 54, 56 span peak 50, and are joined to roof 52 by clips 58, 60. The longer sides of batten 62 are cut at 64′, 64″, as illustrated in FIG. 4B. Batten 62 is then folded so that the longer sides thereof partially overlap, as illustrated in FIG. 4. In this configuration, batten 62 can be slipped over the flanges on adjacent sides of planar sheets 54, 56 to provide a continuous batten structure spanning the peak of roof 52.

Figure 5A:
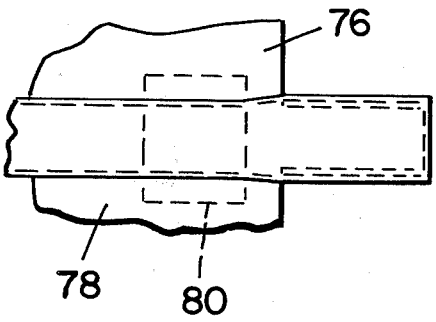
FIGS. 5A and 5B are plan and elevation views respectively of the use of the system of the present invention at the exposed edge of a roof/side junction.
Figure 5B:
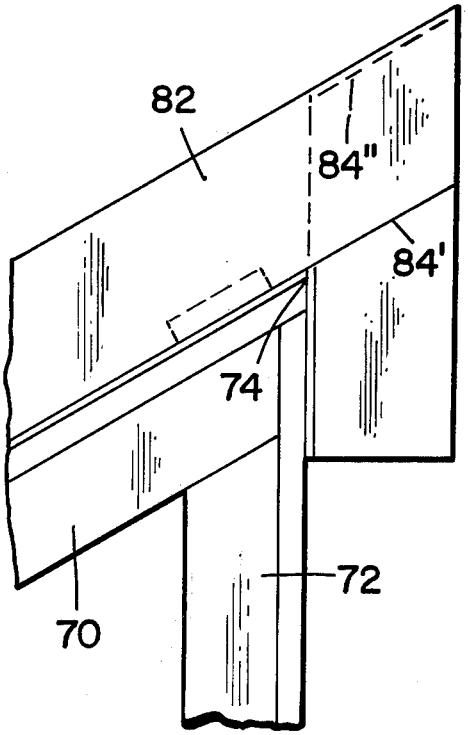

A similar application of the system of the present invention is illustrated in FIGS. 5A and 5B. In this application, a roof 70 is joined to a side wall 72 so as to provide an exposed angle at 74 of greater than 270°. Again, planar sheets such as 76, 78 are placed side-by-side and joined to roof 70 by clips such as 80. The longer sides of batten 82 are cut at 84′, 84″ so that the batten can be folded on itself. It should be noted that a small wedge-shaped portion is cut out of the longer sides of batten 82 so that the batten can be folded through an angle greater than 270°. In this manner, batten 82 can be installed at the adjacent edges of planar sheets 76, 78 to provide a weatherproof connection therebetween.

The system of the present invention can be used as either a roofing or a siding system. In either case, a plurality of planar sheets are joined sequentially in a side-by-side configuration to provide a generally weatherproof surface. As discussed above, the flanges of adjacent sheets are compressed together and caulking may be provided so that water cannot flow between the sheets. In addition, a batten is snapped over adjacent flanges to further waterproof the system. The longer side walls of the batten are generally parallel so that the batten can be cut and folded to fit around the flanges at the junction between non-coplanar surfaces.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A roofing and siding system comprising:

a plurality of elongate, generally planar sheets each having upwardly projecting flanges disposed along the lateral edges of said sheet, said flanges each having an outwardly directed C-shaped cross section, said sheets placed side-by-side so that the lateral edges thereof are contiguous to corresponding lateral edges of adjacent sheets to provide a generally weather-proof surface comprising the exposed surface of a building;

means for attaching the planar sheets to said building comprising a plurality of discrete clips disposed along each pair of contiguous lateral edges of said planar sheets, said clips being attached to the building and in engagement with the adjacent planar sheets to fix said sheets to the building; and a plurality of elongate battens constructed of resilient material, each said batten having a generally rectangular cross section including two longer, substantially parallel sides and two relatively shorter sides, one said shorter side being slit so that the batten can be snapped over adjacent flanges on contiguous lateral edges of two said planar sheets and provide weatherproofing at said edges.

2. A roofing and siding system comprising:

a plurality of elongate, generally planar sheets each having upwardly projecting flanges disposed along the lateral edges of said sheet, said flanges each having an outwardly directed C-shaped cross section with the upper portion of said flange extending outwardly more than the lower portion thereof, said sheets placed side-by-side so that the lateral edges thereof are juxtaposed to corresponding lateral edges of adjacent sheets, the uppper portions of adjacent C-shaped flanges on juxtaposed edges of adjacent sheets being compressed together to provide a generally weatherproof surface comprising the exposed surface of a building;

means for attaching the planar sheets to said building; and a plurality of battens constructed of resilient material, each said batten having a generally rectangular cross section including two longer, substantially parallel sides and two relatively shorter sides, one said shorter side being slit so that the batten can be snapped over adjacent flanges on juxtaposed lateral edges of two said planar sheets and provide further weatherproofing at said edges.

3. A system as recited in claim 2 wherein the longer sides of each of the battens are adapted to be cut so that the battens can be partially folded with said longer sides overlapping to provide continuous weatherproofing at the junction of non-coplanar planar sheets.

4. A system as recited in claim 2 and additionally comprising means for caulking the upper portions of said C-shaped flanges to provide further weatherproofing.

5. A system as recited in claim 2 wherein said attaching means comprises a plurality of discreet clips disposed along each pair of juxtaposed lateral edges of said planar sheets, said clips being attached to the building and in engagement with the adjacent planar sheets to affix said sheets to the building.

6. A roofing and siding system comprising:

a plurality of elongate, generally planar sheets each having upwardly projecting flanges disposed along the lateral edges of said sheet, said flanges each having an outwardly directed C-shaped cross section with the upper portion of said flange extending outwardly more than the lower portion thereof, said sheets placed side-by-side so that the lateral edges thereof are juxtaposed to corresponding lateral edges of adjacent sheets, the upper portions of adjacent C-shaped flanges on juxtaposed edges of adjacent sheets being compressed together to provide a generally weatherproof surface comprising the exposed surface of a building;

means for caulking the upper portions of said C-shaped flanges to provide further weatherproofing;

a plurality of discreet clips disposed along each pair of juxtaposed lateral edges of said planar sheets, said clips being attached to the building and in engagement with the adjacent planar sheets to affix said sheets to the building; and a plurality of elongate battens constructed of resilient material, each said batten having a generally rectangular cross section including two longer, substantially parallel sides and two relatively shorter sides, one said shorter side being slit so that the batten can be snapped over adjacent flanges on juxtaposed lateral edges of two said planar sheets and provide weatherproofing at said edges, the longer sides adapted to be cut so that the battens can be partially folded with said longer sides overlapping to provide a continuous weatherproofing at the junction of non-coplanar planar sheets.

7. A roofing and siding system comprising:

a plurality of elongate, generally planar sheets each having upwardly projecting flanges disposed along the lateral edges of said sheet, said flanges each having an outwardly directed C-shaped cross section, the upper portion of each said C-shaped flange extending outwardly more than the lower portion thereof so that when said sheets are placed side-by-side, the upper portion of adjacent C-shaped flanges on juxtaposed edges of adjacent sheets are compressed together to provide a generally weatherproof surface comprising the exposed surface of a building;

a plurality of means for attaching the planar sheets to said building; and a plurality of elongate battens constructed of resilient material, each said batten having one side slit so that the batten can be snapped over adjacent flanges on juxtaposed lateral edges of two said planar sheets to provide weatherproofing at said edges.

8. A system as recited in claim 7 wherein each said batten is of generally rectangular cross section and includes two longer, substantially parallel sides and two relatively shorter sides, said one side being a relatively shorter side.

9. A system as recited in claim 7 and additionally comprising means for caulking the upper portions of said C-shaped flanges to provide further weatherproofing.

* * * * *